US009498802B2

(12) United States Patent
Varrin, Jr. et al.

(10) Patent No.: US 9,498,802 B2
(45) Date of Patent: Nov. 22, 2016

(54) METHODS OF REUSING A CLEANING SOLUTION

(71) Applicant: Dominion Engineering, Inc., Reston, VA (US)

(72) Inventors: Robert D. Varrin, Jr., Reston, VA (US); Michael J. Little, Ashburn, VA (US)

(73) Assignee: DOMINION ENGINEERING, INC., Reston, VA (US)

( * ) Notice: Subject to any disclaimer, the term of this patent is extended or adjusted under 35 U.S.C. 154(b) by 455 days.

(21) Appl. No.: 13/950,764

(22) Filed: Jul. 25, 2013

(65) Prior Publication Data

US 2014/0026924 A1 Jan. 30, 2014

Related U.S. Application Data

(60) Provisional application No. 61/676,168, filed on Jul. 26, 2012, provisional application No. 61/676,481, filed on Jul. 27, 2012.

(51) Int. Cl.

| | |
|---|---|
| ***B08B 9/00*** | (2006.01) |
| ***B08B 9/027*** | (2006.01) |
| ***B08B 9/08*** | (2006.01) |
| ***G21F 9/00*** | (2006.01) |
| ***C23G 1/36*** | (2006.01) |
| ***F28G 9/00*** | (2006.01) |
| ***C11D 11/00*** | (2006.01) |
| ***F22B 37/48*** | (2006.01) |
| *F28G 15/00* | (2006.01) |

(52) U.S. Cl.

CPC ..... *B08B 9/027* (2013.01); *B08B 9/08* (2013.01); *C11D 11/0041* (2013.01); *C23G 1/36* (2013.01); *F22B 37/483* (2013.01); *F28G 9/00* (2013.01); *G21F 9/004* (2013.01); *F28G 2015/006* (2013.01)

(58) Field of Classification Search

None

See application file for complete search history.

(56) References Cited

U.S. PATENT DOCUMENTS

| | | | |
|---|---|---|---|
| 3,072,502 | A | 1/1963 | Salvatore |
| 6,521,028 | B1 | 2/2003 | Frenier |
| 6,740,168 | B2 | 5/2004 | Rootham et al. |
| 7,344,602 | B2 | 3/2008 | Varrin et al. |
| 7,857,911 | B2 | 12/2010 | Varrin, Jr. et al. |

FOREIGN PATENT DOCUMENTS

| | | | |
|---|---|---|---|
| DE | 198 57 342 | A1 | 2/2000 |
| DE | 10 2007 023247 | B3 | 8/2008 |

OTHER PUBLICATIONS

Notification of Transmittal of the International Preliminary Report on Patentability issued in International Application No. PCT/US2013/052117, dated Aug. 5, 2014.

*Primary Examiner* — Eric Golightly

(74) *Attorney, Agent, or Firm* — Pillsbury Winthrop Shaw Pittman LLP

(57) ABSTRACT

An aqueous cleaning solution that has been previously used to remove deposits from a nuclear steam generator (or other vessel) is reused after being transferred from the steam generator into an external vessel. The spent cleaning solution may be reconditioned and reused in a further cleaning of the same steam generator or a different steam generator. The different cleanings being accomplished by the cleaning solution may be of the same type or different types (e.g., iron oxide removal and/or copper removal).

15 Claims, No Drawings

METHODS OF REUSING A CLEANING SOLUTION

CROSS REFERENCE

This application claims the benefit of priority from U.S. Provisional Application Nos. 61/676,168 and 61/676,481, filed Jul. 26 and 27, 2012, respectively, both titled "Methods Of Reusing A Cleaning Solution," the entire contents of each of which are hereby incorporated by reference herein.

BACKGROUND OF THE INVENTION

1. Field of the Invention

The present invention relates generally to methods for dissolving and removing deposits from vessels such as boilers, heat exchangers, and steam generators, and particularly relates to such methods in connection with vessels in a thermal power plant.

2. Description of Related Art

U.S. Pat. Nos. 6,740,168, 7344,602 and 7,857,911 to Varrin et al. and 6,521,028 to Frenier disclose various methods of dissolving and removing deposits from vessels at thermal power plants such as nuclear power plant steam generators.

SUMMARY OF EMBODIMENTS OF THE INVENTION

One or more embodiments of the current invention provide a method for reconstitution/reformulation and reuse of cleaning solutions for vessels such as boilers, heat exchangers, and steam generators (e.g., nuclear steam generators, SGs), which can be used regardless of the initial concentrations of reducing agent, dissolved metals, defoaming agents, corrosion inhibitors, and/or surfactants present in the solution that is to be re-used.

One or more of these embodiments facilitate enhanced deposit removal with reduced waste volumes and reduced cleaning time. One or more embodiments result in reduced corrosion of components of the vessel being cleaned.

One or more of these embodiments are compatible with equipment used for conventional boiler and SG cleaning processes.

One or more embodiments of the current invention may be used to facilitate reformulation and reuse of a cleaning solution in a subsequent cleaning step with different chemistry that uses a different dissolution mechanism (e.g., reuse of an iron oxide removal solution as a subsequent copper removal solution, after chemistry adjustment and reformulation).

One or more embodiments of the current invention may be used to facilitate reuse of a cleaning solution in a subsequent cleaning step with the same chemistry (e.g., reuse of an iron oxide removal solution in a subsequent iron oxide removal step, after reestablishing reducing conditions, as needed, and adding additional active ingredients or water).

One or more embodiments of the present invention are described in below appended claims.

These and other aspects of various embodiments of the present invention, as well as the methods of operation and functions of the related elements of structure and the combination of parts and economies of manufacture, will become more apparent upon consideration of the following description and the appended claims, all of which form a part of this specification. It should be appreciated that features described in any one embodiment herein can be used in other embodiments as well. As used in the specification and in the claims, the singular form of "a", "an", and "the" include plural referents unless the context clearly dictates otherwise.

DETAILED DESCRIPTION OF EXEMPLARY EMBODIMENTS OF THE INVENTION

Cleaning solutions containing chelants and complexing agents such as ethylenediamine tetraacetic acid, oxalic acid and the like are used to clean industrial heat exchangers such as fossil boilers and nuclear steam generators (SGs), as well as other industrial equipment. Specifically, these cleaning solutions are used to dissolve and remove impurities that are transported to the boilers/SGs in the feed water and accumulate as a result of boiling which takes place on the secondary side of the boilers/SGs during normal operation. Depending on the nature of these impurities, several different solvents with distinct chemistries may be required within a given cleaning process. For example, oxidizing conditions and elevated solvent pH values are generally used to promote dissolution of metallic copper deposits, while reducing conditions and lower pH values are generally used to dissolve iron oxide deposits such as magnetite.

Iron oxide removal solutions used in nuclear SGs also generally contain a reducing agent such as hydrazine, ascorbic acid, or iron oxalates and the like and may also contain corrosion inhibitors, defoamers, and/or surfactants. Reducing agents are sometimes not required in fossil boilers as iron oxide deposits are generally present on carbon steel surfaces, and oxidation of the underlying base metal generally provides the requisite levels of local electron transfer to facilitate reductive dissolution of magnetite deposits without the use of chemical reducing agents in the cleaning solution itself.

Unless otherwise stated, all percentages referenced herein refer to weight percentages. However, equivalent molar percentages can be defined. Because specific chelants and cleaning agents exhibit different molecular weights, one-to-one comparisons of the capacities of candidate cleaning agents would typically be done on a molar basis assuming a 1:1 chelation/complexation with a deposit species, which is reasonable for most cleaning agents such as EDTA, NTA, HEDTA, but not necessarily true for others such as oxalic acid. The discussion herein is based on weight percentages in order to maintain consistency with common notation in technical literature related to industrial chemical cleaning.

Unless otherwise specifically stated, the terms "about" and "generally," with respect to values, means within 10% of the least significant unit. Thus, for example, "about 0.1" means between 0.09 and 0.11.

In many cases, the chelants and complexing agents are used at concentrations in the range of 1% to 20% by wt., which is well below their solubility limits in aqueous cleaning solutions (typically about. 40% by wt., but may be higher or lower depending on the exact chelant or complexing agent used). As such, additional chelant or complexing agent may be added directly to the boiler/SG during the cleaning process in order to promote additional deposit removal. Such additions may be performed as part of a continuation of the same cleaning step (e.g., additional iron oxide removal solution injected at the completion of an iron oxide removal step), or may be performed along with addition of other chemicals in order to transition to a different type of cleaning step (e.g., copper removal chemicals injected at the completion of an iron oxide removal step, followed by oxidant (e.g., hydrogen peroxide or ammonium persulfate) addition, or air or oxygen or ozone sparging to establish oxidizing conditions). Sequential chemical additions, such as described above, are preferred in lieu of completely draining and refilling the boiler/SG with fresh cleaning solutions because this approach minimizes the volume of liquid waste generated and associated waste disposal costs.

Such chemical additions, including possible transitions between iron oxide and copper removal chemistries, are generally achievable within a boiler/SG when the residual concentration of reducing agent used in the iron oxide removal solution and to be consumed in the copper removal solution is relatively low, as would be the case for dilute cleaning solutions such as discussed in U.S. Pat. Nos. 6,740,168, 7,344,602 and 7,857,911, or cleaning solutions used to clean fossil boilers such as disclosed in U.S. Pat. No. 6,521,028 (which generally do not include reducing agents). However, reconstitution and reuse of cleaning solutions in this manner becomes increasingly challenging as the target level of deposit removal is increased as this may require higher concentrations of reducing agents at the beginning of the iron oxide removal step and consequently higher residual reducing agent at the end of the iron oxide removal step. These higher capacity solutions also generally contain higher concentrations of chelants/complexing agents and dissolved metals, and may also contain corrosion inhibitors and/or defoamers, which further complicate subsequent chemical additions, including possible transitions between iron oxide and copper removal chemistries.

For example, to achieve enhanced iron oxide deposit removal from a nuclear SG, cleaning solutions comprising increased concentrations of chelant/completing agent (e.g., over about (or over exactly) 1%, 2%, 3%, 5%, and/or 10%, between 1 and 40%, between 1 and 20%, less than 40%, and/or less than 20%) and increased concentrations of reducing agent (over about (or over exactly) 0.1%, 0.2%, 0.3%, 0.5%, and/or 1.0%, between 0.1 and 10%, and/or less than 10%) are generally used. In addition, such formulations typically use defoamers to mitigate solvent foaming and corrosion inhibitors to mitigate corrosion during the cleaning process. Reconstitution and reuse of depleted solvent/liquid waste from the iron oxide removal step(s) as a subsequent copper removal solution in situ has generally not been possible with such formulations for the following reasons:

Increased concentration of residual reducing agent inhibits copper removal during the follow-on copper removal step.

Increased concentration of residual reducing agent can result in excessive corrosion of carbon steel components present in the SG during the in-situ (i.e., within the SGs) transition from reducing conditions (required during the iron oxide removal step) to oxidizing conditions (required during the metallic copper removal step).

Increased concentrations of chelant/complexing agent and dissolved metals, as well as the presence of defoamers, corrosion inhibitors and surfactants, may also lead to instabilities of dissolved metallic species following chemical additions and/or during chemistry transition periods. (Such instabilities may lead to precipitation of metallic species within the SG, rather than dissolution, retention and removal from the SGs.)

One or more embodiments of the current invention provide a means for reducing or minimizing waste disposal costs, reducing required cleaning time, reducing corrosion and increasing the stability of dissolved metal complexes, for example in cleaning applications in which enhanced deposit removal is required or desired.

One or more of these embodiments of the current invention involves the reconstitution/reformulation and reuse of liquid waste from an iron oxide removal cleaning step as a copper removal solution. One or more of these embodiments may be particularly beneficial when the spent iron oxide removal solution contains: (1) a chelant or complexing agent at a concentration less than the solubility limit of said chelant or complexing agent (typically less than about 40% by wt., but may be higher of lower depending on the exact chelant or complexing agent used), and (2) a reducing agent at a high concentration (e.g., greater than or equal to 0.09%, 0.10%, 0.15%, and/or 0.2%, and/or concentrations sufficiently high as to require a significant time (e.g., between 2 and 20 hours or longer) to decompose upon transition to oxidizing conditions), and may also be beneficial when a defoamer or corrosion inhibitor is used in the iron oxide removal solution. Similar to comments made above for chelant/complexing agent concentrations, equivalent molar percentages can also be defined for reducing agents, and may be more appropriate in some cases, particularly when the concentration/strength of two different reducing agents is being compared. One or more of these embodiments involves the following process steps:

At the completion of the iron oxide removal step, the cleaning solution is transferred from the boiler/SG to an external vessel (e.g., any vessel that is not part of the vessel being cleaned, such as a temporary tank supplied as part of temporary cleaning equipment, a tank or vessel that already exists at the plant, or another suitably-sized vessel). According to various embodiments, at least 40, 50, 60, 70, 80, 90, 95, 97, 98, and/or 99% of the cleaning solution in the boiler/SG is transferred to the external vessel.

If the copper removal cleaning step will be performed immediately after the iron oxide removal step, concentrated copper removal chemicals can be injected to said external vessel immediately after the iron oxide removal solution is drained to said external vessel. Copper removal chemicals may also be injected into the external vessel before the iron oxide solution is transferred from the boiler/SG to the external vessel, such that the two solutions mix as the iron oxide solution is transferred. The concentrated copper removal chemicals may contain chelants or complexing agents such as ethylenediamine tetraacetic acid, ethylenediamine (EDA) and the like, pH adjust agents such as ammonium hydroxide, amines, quaternary ammonium hydroxides and the like, and/or pH stabilization agents such as ammonium carbonate, ammonium bicarbonate, ammonium salts and the like. Once concentrated copper removal solutions are homogenized as reconstituted/reformulated cleaning solutions at the concentrations and volumes expected to subsequently be used within the boiler/SG, these copper removal solutions typically contain 0.1% to 10%, 0.1% to 5.0%, 0.5% to 5.0%, 1.0% to 5.0%, and/or 2.0% to 5.0% free chelant or complexing agent (e.g., EDTA, EDA) and 0.005% to 5%, 0.01% to 5%, 0.01% to 1.0%, and/or 0.1% to 0.5% pH stabilization/buffering agent (e.g., ammonium bicarbonate, ammonium carbonate, ammonium salt(s), and/or other pH stabilization or buffering agent(s)) at pH values between 7 and 11 and/or between pH 9 and 10. If the copper removal cleaning step is to be performed at a later date, e.g., during a subsequent maintenance outage, the spent iron oxide removal solution may be stored for extended periods (e.g., at least one week, at least two weeks, at least a month, at least two months, and/or at least a year) in said external vessel, prior to introducing the concentrated copper removal chemicals. Performing the injection of concentrated copper removal chemicals before proceeding to the step below (introduction of oxidant to the external test vessel) may be helpful according to one or more embodiments to stabilize metal complexes in solution and prevent, inhibit, or reduce the formation of unwanted precipitates by ensuring that free chelant or complexing agent is present throughout the conversion process.

After introduction of copper removal chemicals to said external vessel, an oxidant is introduced to said external vessel to scavenge and remove (i.e., reducing the residual concentration to below 0.1 and/or 0.01 weight %) any residual reducing agent present from the iron oxide removal solution and to establish oxidizing conditions. The oxidant may be hydrogen peroxide, ozone, oxygen, air or similar chemicals. Oxygen is the preferred oxidant due to its ease of use and its ability to establish high oxidation/reduction potentials during the copper removal step, which is beneficial for copper removal. The oxidant used to scavenge the residual reducing agent may be provided in a variety of different ways, including as a compressed gas, as a cryogenic fluid, via in-situ production such as by pressure swing adsorption (PSA), or by other equivalent means. The oxidant may also be introduced to the solution present in the external vessel in a variety of different ways, including direct injection by means such as sparging or bubbling, through indirect means such as sparging into an external recirculation path while recirculating the solution to be converted, by passing the solution through a gas-liquid contactor such as a packed bed column operated in downflow or upflow in order to enhance reducing agent removal, and/or by other suitable means. In some embodiments, it may be beneficial to admix an inert gas with the oxidant during the conversion process.

After the reducing agent is removed and oxidizing conditions have been established in said external vessel, the resulting copper removal solution is then injected back to the boiler/SG in order to initiate the copper removal cleaning step. Prior to reinjection to the boiler/SG, the solvent chemistry may be further adjusted, if needed, e.g., in the event that a pH decrease has occurred during the transition from reducing to oxidizing chemistry or as a result of extended storage of the cleaning solution. According to various embodiments, at least 40, 50, 60, 70, 80, 90, 95, 97, 98, and/or 99% of the cleaning solution in the external vessel is transferred back into the boiler/SG.

Removal of residual reducing agent in an external vessel (as described above) according to one or more embodiments may facilitate conversion to oxidizing conditions without resulting in excessive carbon steel corrosion of boiler or SG internals, which might be expected if the conversion process were performed within the SG itself in the presence of high concentrations of residual reducing agent. Upon reintroduction to the boiler/SG, the reconstituted solution containing the chelant and oxidant quickly passivates carbon steel surfaces present within the boiler/SG, which further reduces corrosion. The external conversion may also provide an opportunity to verify the copper removal solution chemistry and effectiveness by chemical analysis or electrochemical analysis prior to introduction to the boiler/SG and results in enhanced copper removal effectiveness upon reintroduction of the copper removal solution to the boiler/SG, as the reducing agent is completely removed in advance. This generally allows the copper removal process to be completed within a shorter duration (relative to processes in which the transition from reducing to oxidizing conditions is performed in-situ), thereby reducing the overall cleaning time.

If the concentration of residual reducing agent such as hydrazine present as a residual from the iron oxide removal step is less than about 0.1%, it may be possible to perform in-situ conversion from reducing to oxidizing conditions (i.e., within the boiler/SG itself) with acceptably low (e.g. <25 micron) corrosion of carbon steel components present within the boiler/SG. However, the presence of corrosion inhibitors in these solutions, combined with elevated concentration of dissolved metals, may lead to instabilities during the conversion process. See, for example, Guidelines for Chemical Cleaning of Conventional Fossil Plant Equipment, EPRI, Palo Alto, Calif.: 2001. 1003994. Thus, external removal of reducing agent (as described above) is generally preferred according to various embodiments. Further, the sequence of steps outlined above, including introduction of copper removal chemicals (i.e., free chelant/complexing agent) prior to introduction of the oxidant, may result in increased stability of dissolved metal complexes during the conversion process.

One or more of these embodiments has little or no impact on equipment typically used during boiler/SG cleaning applications. For example, one or more of these embodiments involves the use of only one additional external vessel (e.g., any vessel that is not part of the vessel being cleaned, such as a temporary tank supplied as part of temporary cleaning equipment, a tank or vessel that already exists at the plant, or another suitably-sized vessel) to facilitate external consumption of the residual reducing agent. If a plant is comprised of multiple boilers/SGs, this external vessel may be used to process/convert waste from all boilers/SGs sequentially (i.e., one boiler/SG at a time) in order to minimize equipment complexity. Alternatively, this external vessel or a plurality of external vessels may be used to convert waste from all boilers/SGs in parallel (i.e., waste from all boilers/SGs converted simultaneously) in order to minimize the overall time required for waste conversion.

One or more of these embodiments may be particularly suitable for use in nuclear SGs. More specifically, high concentrations of reducing agent such as hydrazine (greater than about 0.1% and often as high as 1 to 3%) are generally used to promote iron oxide dissolution and mitigate corrosion during the cleaning steps used for nuclear steam generators. These steps are designed to facilitate enhanced removal of iron oxide deposits (e.g., greater than 500, 600, 700, 800, 900, 1,000, 1,250, 1,500, and/or 2000 kg/SG based on a typical cleaning solvent fill volume from 10,000 to 18,000 gallons per boiler/SG (although the fill volume may be above or below this range without deviating from the scope of various embodiments)). According to various embodiments, such cleanings may remove, for example, at least 0.02, 0.03, 0.05, 0.10, 0.15, and/or 0.20 kg of iron oxide deposits per gallon fill volume of the boiler/SG but still have in excess of 0.1% residual reducing agent such as hydrazine at the completion of the iron oxide removal step. The time used for in situ decomposition of this residual reducing agent after introduction of the oxidant, and the consequent corrosion, can be high. As noted above, reducing agents are generally not required during iron oxide removal steps in fossil boilers so external conversion (as is described above) may not be required for fossil boiler cleanings. Nonetheless, one or more of these embodiments may be applicable to fossil boiler cleanings and other industrial cleaning processes that involve the removal of iron oxide and metallic copper deposits in a single chemical batch.

In one or more embodiments in which the concentration of chelant or complexing agent present in the resulting cleaning solution remains below its solubility limit, the liquid waste solution from the cleaning application may be stored and reconstituted/reused multiple times according to the embodiment described above. It is also possible to reuse waste from a copper removal step to prepare a fresh copper removal solution according to one or more of these embodiments.

The cleaning solution may be reused in the same SG and/or a different SG in the same reactor or power plant and/or a different reactor or power plant.

One or more embodiments of the current invention comprise the reuse of liquid waste from an iron oxide removal step to prepare a fresh iron oxide removal solution when the chelant or complexing agent is present below its saturation concentration (solubility) in the liquid waste. This is done by introducing additional active cleaning agent and other additives to the depleted solvent/liquid waste, as appropriate, and reintroducing this replenished cleaning solution to the heat exchangers or other equipment. This replenishment process may be repeated multiple times until the solution becomes saturated with the cleaning agent such that the liquid waste has no additional capacity to dissolve active cleaning agent. Further, this strategy may be combined with the use of ion exchange resins or other suitable methods to remove dissolved metals and regenerate free chelant/complexing agent, thereby further increasing the effective dissolution capacity of the solvent.

Reuse of liquid waste, as described above, may be performed by introducing additional active cleaning agent and other additives to the boiler/SG directly without draining the liquid waste from the previous cleaning step. Alternatively, liquid waste may be drained from the boiler/SG, the chemistry may reconstituted in an external vessel (either immediately after completion of the prior cleaning step or after an extended storage period) and then reintroduced to the boiler/SG. Depending on the duration of storage and storage conditions, the liquid waste may need to be processed, as appropriate, prior to introducing additional active cleaning agent and other additives to the liquid waste and reintroducing this replenished cleaning solution to the boiler/SG. For example, assuming the subsequent cleaning solution will be used to remove iron oxide deposits, prior to reconstitution and reuse, the liquid waste may need to be deaerated. This could be accomplished in many ways, including but not necessarily limited to:

1. Recirculation and degasification of the liquid waste,
2. Inert gas sparging, and/or
3. Addition of chemical reducing agent(s).

As an alternative to the techniques described above, the liquid waste may be continuously stored in an environment that would prevent the need for deaeration prior to replenishment and reuse of the liquid waste. For example, the liquid waste may be stored under inert gas blanket to prevent air ingress. Even under these storage conditions, it may be advantageous to analyze the liquid waste for dissolved oxygen and presence of oxidized iron species prior to reuse.

For reference, the solubility of ethylenediaminetetraacetic acid (EDTA), a typical cleaning agent/chelant used in industrial cleaning processes, is on the order of 40% in aqueous solutions. As such, one or more embodiments of the current invention could be used to facilitate the reuse of conventional cleaning solutions, which typically contain between 1% and 20% EDTA, respectively.

One or more embodiments of the invention comprises reuse of liquid waste as a new cleaning solution by converting complexed active cleaning agent present in liquid waste to free (uncomplexed) active cleaning agent, thereby regenerating the cleaning capacity of the original cleaning solution. This may be accomplished in many ways, including but not necessarily limited to:

1. Recirculation of the liquid waste through an ion exchange resin to remove metal species complexed by the active cleaning agent,
2. Addition of chemical agents which react with, precipitate, or otherwise remove metal species from active cleaning agent complexes, and/or
3. Establishment of electrochemical conditions that result in the removal of metal species from active cleaning agent complexes.

Note that the corrosion which occurs in reconstituted iron oxide removal cleaning solutions is determined by, among other things, the concentration of free (uncomplexed) active cleaning agent present in the reconstituted iron oxide cleaning solution, not the total concentration. For example, if additional chelant is introduced to liquid waste containing 20% complexed chelant to raise the total concentration of chelant (free and complexed) to 21%, the corrosivity of the resulting iron oxide cleaning solution would be expected to be equivalent to that of an iron oxide cleaning solution containing 1% total chelant in free (uncomplexed) form. Reconstituted copper removal solutions are non-corrosive so corrosion is not expected in this type of solution, regardless of the chelant or complexing agent solution.

In one or more embodiments of the current invention, the corrosion impact of iron oxide removal steps may be further reduced by introducing a benign solution (e.g., demineralized water) in one or more regions of the boiler/SG in order to prevent cleaning solutions from contacting internal surfaces that are susceptible to corrosion. For example, following injection of an iron oxide removal solution, demineralized water may be introduced to the annulus formed between the boiler/SG shell and the tube bundle wrapper, thereby inhibiting potentially-corrosive chemicals from contacting pressure boundary components such as the boiler/SG shell. Since critical fouling deposits are typically not located in this annulus region, cleaning solutions are typically not needed in this region of the heat exchanger.

One or more embodiments of the current invention have been tested multiple times by the inventors.

According to some embodiments, the number of times that the cleaning solution can be reconstituted and reused may be limited by the solubility of the active cleaning agents used within the cleaning solution. Once the cleaning solution becomes saturated in one or more cleaning agent, further reconstitution may not be possible and the resulting liquid waste may have to be processed and/or disposed of in accordance with standard industrial practices. Alternatively and/or additionally, the cleaning solution may be reconstituted by uncomplexing some of the cleaning agent (e.g., through the use of ion exchange resins to remove complexed metals, or by other suitable method(s)) so that free cleaning agent is present below the saturation point of the cleaning agent.

One or more embodiments of the current invention include the following features:

i) The reconstitution/reformulation and reuse of depleted solvent/liquid waste from the chemical cleaning of fossil boilers, nuclear SGs or other industrial equipment in order to formulate new cleaning solutions by replenishing or regenerating the active cleaning agent and/or chemical additives. If replenishment is performed, the same active cleaning agent and/or chemical additives used in the original cleaning solution, or a different active cleaning agent and/or chemical additives, may be used to formulate the new cleaning solutions. For example, an iron oxide removal solution containing EDTA, oxalic acid or another suitable chelant or complexing agent, hydrazine or another suitable reducing agent, a defoamer and/or a corrosion inhibitor may be reconstituted as a copper removal solution containing EDTA, EDA, or another suitable chelant/complexing agent, ammonium hydroxide, amines, quaternary ammonium hydroxides or another suitable pH adjust agent, and/or ammonium carbonate, ammonium bicarbonate, ammonium salts or another suitable pH stabilization agent. As discussed above, reuse of liquid waste in this manner may advantageously minimize or reduce cumulative corrosion of carbon steel and low alloy steel equipment internals, as well as overall costs associated with a given cleaning application or applications, primarily those associated with waste disposal.

ii) The chemistry adjustment and reuse of liquid waste in a manner that allows for the removal of different deposit species (e.g., iron oxides and metallic copper) using a single steam generator fill volume of cleaning solution. When elevated concentrations of reducing agent (greater than about 0.1%) and/or corrosion inhibitors (e.g., amine borate salts or esters, long-chain pyridinium salts such as n-dodecyl pyridinium bromide derivatives, including those synthesized in low toxicity glycol ethers and/or aliphatic alcohols, alkyl pyridines, sulfur-modified alkyl pyridines, alkyl tetrahydropyrimidines, sulfur-containing compounds, sulfur-containing polyamides, urea compounds, thiourea, propargyl alcohol alkoxylate, ethynylcarbino-allcoxylate, tetraimadazoline derivatives, imino-amido condensation products, high molecular weight amines, alkyldiamines, polyamines, amphoteric amines, acetylenic compounds, arylamines, aromatic N-heterocyclic compounds and N-heterocyclicamines or similar compounds or combinations thereof) are present in the iron oxide removal solution, the copper removal solution may be reconstituted in an external vessel, then reintroduced to the boiler/SG, in order to: (1) eliminate corrosion which would otherwise occur at the start of the copper removal step, and (2) enhance the effectiveness of the copper removal process. One or more of these methods may help to ensure that free chelant/complexing agent is continuously present during the external conversion process in order to stabilize metal complexes in solution and prevent the formation of precipitates, which may otherwise form under these conditions.

iii) Further reduction of corrosion by introducing a benign cleaning solution (e.g., demineralized water) in one or more regions of a boiler/SG in order to prevent or inhibit cleaning solutions from contacting internal surfaces that are susceptible to corrosion.

Although embodiments of the present invention are discussed with respect to boilers and SGs (e.g., of nuclear power plants), various embodiments of the present invention may additionally and/or alternatively be used in connection with other types of structures in which it is desired to remove deposits (e.g., other parts of a primary or secondary cooling circuit of a nuclear power plant).

The foregoing illustrated embodiments are provided to illustrate the structural and functional principles of embodiments of the present invention and are not intended to be limiting. To the contrary, the principles of the present invention are intended to encompass any and all changes, alterations and/or substitutions within the spirit and scope of the following claims.

What is claimed is:

1. A method of removing at least some deposits within one or more steam generators of one or more nuclear power plants, the method comprising:

disposing an aqueous cleaning solution in a first nuclear steam generator for a first treatment period to dislodge or dissolve first deposits from the first nuclear steam generator, the aqueous cleaning solution comprising a chelant or cleaning agent;

after said disposing of the aqueous cleaning solution in the first steam generator, transferring the aqueous cleaning solution and at least some of the dislodged or dissolved first deposits from the first nuclear steam generator to an external vessel;

transferring the aqueous cleaning solution from the external vessel into the first nuclear steam generator or a second nuclear steam generator and keeping the aqueous cleaning solution in the first or second nuclear steam generator for a second treatment period to dislodge or dissolve second deposits from the first or second nuclear steam generator; and after said keeping of the aqueous cleaning solution in the first or second nuclear steam generator for the treatment period, removing the aqueous cleaning solution and at least some of the dislodged or dissolved second deposits from the first or second nuclear steam generator.

2. The method of claim 1, further comprising, between (1) transferring the aqueous cleaning solution and at least some of the dislodged or dissolved first deposits from the first nuclear steam generator to the external vessel and (2) keeping the aqueous cleaning solution in said first or second nuclear steam generator for the second treatment period: introducing additional chelant or cleaning agent into the aqueous cleaning solution.

3. The method of claim 1, wherein:

said dislodging or dissolving of the first deposits from the first nuclear steam generator comprises complexing the deposits with the chelant or cleaning agent; and the method further comprises, between (1) transferring the aqueous cleaning solution and at least some of the dislodged or dissolved first deposits from the first nuclear steam generator to the external vessel and (2) keeping the aqueous cleaning solution in said first or second nuclear steam generator for the second treatment period: uncomplexing at least some of the complexed chelant or cleaning agent from the complexed deposits so as to regenerate a deposit-removal capacity of the chelant or cleaning agent by increasing a degree to which the chelant or cleaning agent is uncomplexed and therefore active.

4. The method of claim 1, wherein transferring the aqueous cleaning solution from the external vessel into the first or second nuclear steam generator comprises transferring at least some of the dislodged or dissolved first deposits into the first or second nuclear steam generator.

5. The method of claim 1, wherein:

disposing the aqueous cleaning solution in the first nuclear steam generator for the first treatment period comprises disposing the aqueous cleaning solution in the first nuclear steam generator in a reducing condition for the first treatment period to dislodge or dissolve iron oxide deposits;

the dislodged or dissolved first deposits comprise dislodged or dissolved iron oxide deposits;

keeping the aqueous cleaning solution in said first or second nuclear steam generator for the second treatment period comprises keeping the aqueous cleaning solution in said first or second nuclear steam generator in a reducing condition for the second treatment period to dislodge or dissolve iron oxide deposits; and the dislodged or dissolved second deposits comprise dislodged or dissolved iron oxide deposits.

6. The method of claim 5, further comprising, between (1) transferring the aqueous cleaning solution and at least some of the dislodged or dissolved first deposits from the first nuclear steam generator to the external vessel and (2) keeping the aqueous cleaning solution in said first or second nuclear steam generator for the second treatment period: deaerating the aqueous cleaning solution.

7. The method of claim 1, wherein the first or second nuclear steam generator is the second nuclear steam generator such that transferring the aqueous cleaning solution from the external vessel into the first or second nuclear steam generator comprises transferring the aqueous cleaning solution into the second nuclear steam generator.

8. The method of claim 1, wherein the first or second nuclear steam generator is the first nuclear steam generator such that:

transferring the aqueous cleaning solution from the external vessel into the first or second nuclear steam generator comprises transferring the aqueous cleaning solution back into the first nuclear steam generator; and keeping the aqueous cleaning solution in said first or second nuclear steam generator for the second treatment period comprises keeping the aqueous cleaning solution in said first nuclear steam generator for the second treatment period.

9. The method of claim 8, further comprising, between (1) transferring the aqueous cleaning solution from the first nuclear steam generator to an external vessel and (2) keeping the aqueous cleaning solution in said first nuclear steam generator for the second treatment period:

introducing additional chelant or cleaning agent into the aqueous cleaning solution.

10. The method of claim 8, wherein:

disposing the aqueous cleaning solution in the first nuclear steam generator for the first treatment period comprises disposing the aqueous cleaning solution in the first nuclear steam generator in a reducing condition for the first treatment period to dislodge or dissolve iron oxide deposits;

the dislodged or dissolved first deposits comprise dislodged or dissolved iron oxide deposits;

the method further comprises, before said keeping the aqueous cleaning solution in said first nuclear steam generator for the second treatment period, converting the aqueous cleaning solution from a reducing condition to an oxidizing condition;

keeping the aqueous cleaning solution in said first nuclear steam generator for the second treatment period comprises keeping the aqueous cleaning solution in said first nuclear steam generator in an oxidizing condition for the second treatment period to dislodge or dissolve copper deposits; and the dislodged or dissolved second deposits comprise dislodged or dissolved copper deposits.

11. The method of claim 10, wherein the aqueous cleaning solution disposed in the first nuclear steam generator in the reducing condition for the first treatment period comprises a corrosion inhibitor.

12. The method of claim 10, wherein:

the aqueous cleaning solution disposed in the first nuclear steam generator in a reducing condition for the first treatment period comprises a reducing agent, and converting the aqueous cleaning solution from a reducing condition to an oxidizing condition comprises decreasing an amount of the reducing agent in the aqueous cleaning solution.

13. The method of claim 10, wherein the converting of the aqueous cleaning solution from a reducing condition to an oxidizing condition occurs before the transferring of the aqueous cleaning solution back into the first nuclear steam generator.

14. The method of claim 8, wherein:

disposing the aqueous cleaning solution in the first nuclear steam generator for the first treatment period comprises disposing the aqueous cleaning solution in the first nuclear steam generator in an oxidizing condition for the first treatment period to dislodge or dissolve copper deposits;

the dislodged or dissolved first deposits comprise dislodged or dissolved copper deposits;

the method further comprises, before said keeping of the aqueous cleaning solution in said first nuclear steam generator for the second treatment period, converting the aqueous cleaning solution from an oxidizing condition to a reducing condition;

keeping the aqueous cleaning solution in said first nuclear steam generator for the second treatment period comprises keeping the aqueous cleaning solution in said first nuclear steam generator in a reducing condition for the second treatment period to dislodge or dissolve iron oxide deposits; and the dislodged or dissolved second deposits comprise dislodged or dissolved iron oxide deposits.

15. The method of claim 8, further comprising:

before disposing an aqueous cleaning solution in the first nuclear steam generator for the first treatment period, taking the first nuclear steam generator out of service; and between (1) transferring the aqueous cleaning solution from the first nuclear steam generator to an external vessel and (2) transferring the aqueous cleaning solution back into the first nuclear steam generator: returning the first nuclear steam generator to service, and thereafter taking the first nuclear steam generator out of service again before said transferring of the aqueous cleaning solution back into the first nuclear steam generator.

* * * * *